US005145269A

United States Patent [19]

Matsuda et al.

[11] Patent Number: 5,145,269

[45] Date of Patent: Sep. 8, 1992

[54] PRINTER WITH A PLURALITY OF INK RIBBON CASSETTES HAVING A CAM LIFT MECHANISM CONTROLLED BY A STEPPER MOTOR

[75] Inventors: Shinji Matsuda, Uji; Kenji Sugimura, Yamato-Koriyama; Youichi Nakanishi, Gose, all of Japan

[73] Assignee: Sharp Kabushiki Kaisha, Osaka, Japan

[21] Appl. No.: 588,135

[22] Filed: Sep. 26, 1990

[30] Foreign Application Priority Data

Oct. 3, 1989 [JP] Japan ..... 1-259423

[51] Int. Cl.[5] ..... B41J 35/22

[52] U.S. Cl. ..... 400/216.2; 400/211; 400/212

[58] Field of Search ..... 400/216.2, 211, 225, 400/212, 216, 216.1; 318/691

[56] References Cited

U.S. PATENT DOCUMENTS

| | | | |
|---|---|---|---|
| 4,672,283 | 6/1987 | Kobayashi | 318/696 |
| 4,698,567 | 10/1987 | Gottwald et al. | 400/212 |
| 4,833,372 | 5/1989 | Kobayashi et al. | 318/696 |
| 4,944,618 | 7/1990 | Ideta | 400/211 |
| 4,982,146 | 1/1991 | Moteki | 318/696 |

FOREIGN PATENT DOCUMENTS

| | | | |
|---|---|---|---|
| 59-194884 | 11/1984 | Japan . | |
| 61-182961 | 8/1986 | Japan . | |
| 0083175 | 4/1987 | Japan | 400/211 |

OTHER PUBLICATIONS

The English Abstracts of the above identified applications.

Patent Abstracts of Japan, vol. 11, No. 393 M-654, Jul. 1987.

IBM Technical Disclosure Bulletin, vol. 29, No. 3, Aug. 1986.

Feinwektechn and Messtech, vol. 86, No. 4, 1978.

*Primary Examiner*—Edgar S. Burr

*Assistant Examiner*—John S. Hilten

*Attorney, Agent, or Firm*—Birch, Stewart, Kolasch & Birch

[57] ABSTRACT

A printer with a plurality of ink ribbon cassettes is capable of printing characters or designs with a selected one of these ink ribbon cassettes. The printer includes a vertically movable cassette table on which the plurality of ink ribbon cassettes are mounted in a stacked relationship, a stepping motor, and a rotary cam mechanism for moving the cassette table up and down when the stepping motor drives to rotate the rotary cam mechanism. There is further provided a memory for pre-storing the rotational speed data for each rotational angle of the rotary cam mechanism according to a variation pattern of load applied to the stepping motor together with the rotation of the rotary cam mechanism. The rotational speed of the stepping motor is controlled accoding to the rotational speed data corresponding toe ach rotational angle of the rotary cam mechanism read out of the memory.

14 Claims, 6 Drawing Sheets

PRINTER WITH A PLURALITY OF INK RIBBON CASSETTES HAVING A CAM LIFT MECHANISM CONTROLLED BY A STEPPER MOTOR

BACKGROUND OF THE INVENTION

1. Field of the Invention

The present invention relates to a printer with a plurality of ink ribbon cassettes. More particularly, the invention relates to a printer which allows a print head to be opposed to any one of the ink ribbon cassettes for respective colors so that it can print characters or patterns in a desired color.

2. Description of the Related Art

A printer which is capable of printing characters or patterns in several colors normally mounts a plurality of printing ink ribbon cassettes for respective colors on a vertically movable cassette table for movement up and down the cassette table with a cam mechanism driven by a motor in order that a desired ink ribbon cassette is allowed to be opposed to a print head. This type of printer has been disclosed in the Japanese Patent Application Laying Open (KOKAI) No. 61-182961, laid open on Aug. 15, 1986.

Another printer which is capable of printing characters is operated to move an ink ribbon up and down providing several colors with a cam mechanism driven by a stepping motor in order that a ribbon portion of a desired color is opposed to a print head. This type of printer has been disclosed in the Japanese Patent Application Laying Open (KOKAI) No. 59-194884, laid open on Nov. 5, 1984.

As shown in FIG. 1, those printers are designed to control the drive motor of the ink ribbon cassettes or of the ink ribbon in a manner to keep a rotational speed of the motor constant irrespective of load variation. When the load reaches a maximum peak, therefore, the motor rotates too fast to reach the drive torque which allows positive drive. In particular, if the drive motor employs a stepping motor, it may be stepped out.

In order to prevent the motor from being stepped out when drive torque is short, the rotational speed of the stepping motor should be set low. However, such setting results in enlarging the drive torque, which may heat the stepping motor. In particular, if a carriage is iteratively moved up and down for frequently switching the colors, abnormal heating may occur in the stepping motor and be finally burnt out. Moreover, as the rotational speed of the motor is set lower, the cassette table is slowly moved up and down, resulting in a shortcoming that it takes a long time to switch the printing ink cassette. Accordingly, it has been impractical to set the rotational speed of the motor low if there has existed a requirement for the quick and smooth switching of the ink cassette.

SUMMARY OF THE INVENTION

It is therefore an object of the present invention to provide a printer which is capable of quickly switching printing ink ribbon cassettes and preventing the stepping motor for driving a carriage from being stepped out and excessively heated.

In carrying out the object in a preferred mode, the printer of the invention includes a vertically movable cassette table on which a plurality of ink ribbon cassettes are mounted, a stepping motor, and a rotation cam mechanism for moving up and down the cassette table with the stepping motor. Further, the printer provides a memory which serves to store rotational speed data corresponding to the variation pattern of load applied to the stepping motor together with the rotation of the rotational cam mechanism. The load variation pattern corresponds to each rotational angle of the rotary cam mechanism. The printer serves to control the rotational speed of the stepping motor in response to the rotational speed data obtained for each rotational angle of the rotational cam mechanism read out of the memory.

Preferably, the rotational speed data the memory pre-stores for each rotational angle of the rotary cam mechanism should be arranged to increase the rotational speed if the load applied to the stepping motor is reduced together with the rotation of the rotary cam mechanism.

For preventing the stepping motor from being stepped out, the printer is capable of lowering the speed of the stepping motor during the high load time for the purpose of increasing the driving torque. During the low load time, the printer is capable of increasing the speed of the stepping motor for the purpose of preventing the motor from being heated too much. This results in being able to quickly and smoothly switch the ink ribbon cassette.

Further objects and advantages of the present invention will be apparent from the following description of the preferred embodiments of the invention as illustrated in the accompanying drawings.

DESCRIPTION OF THE PREFERRED EMBODIMENTS

Figure 2:
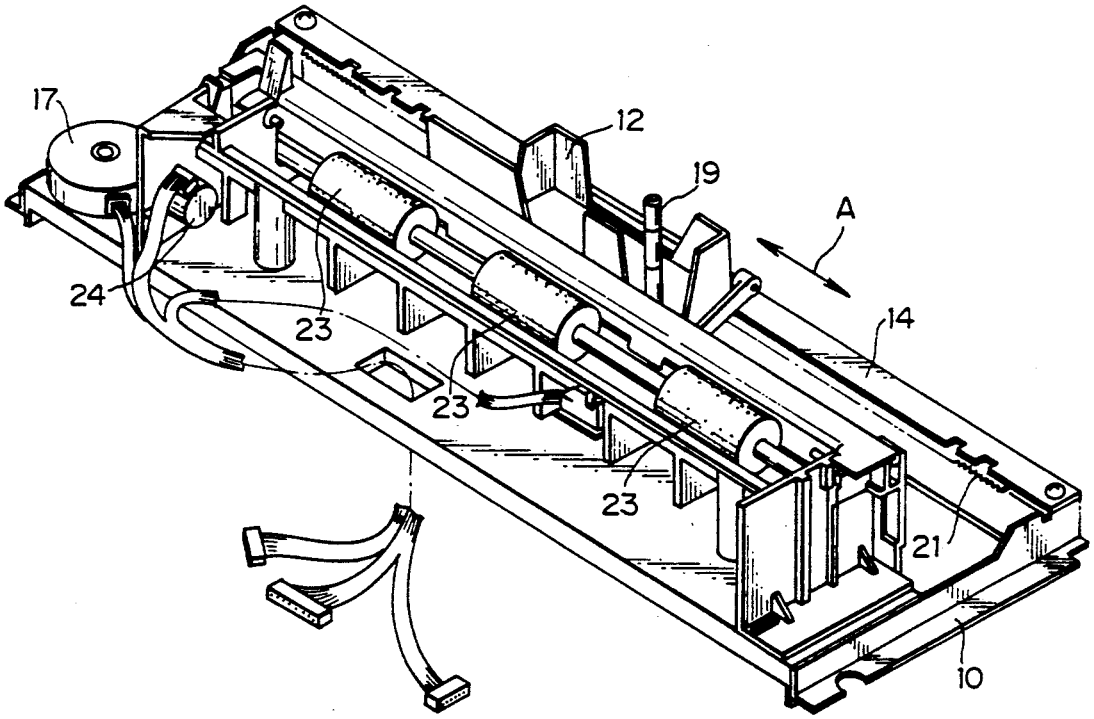
FIG. 2 is a perspective view schematically showing construction of a print unit according to a preferred embodiment of the invention.
Figure 3:
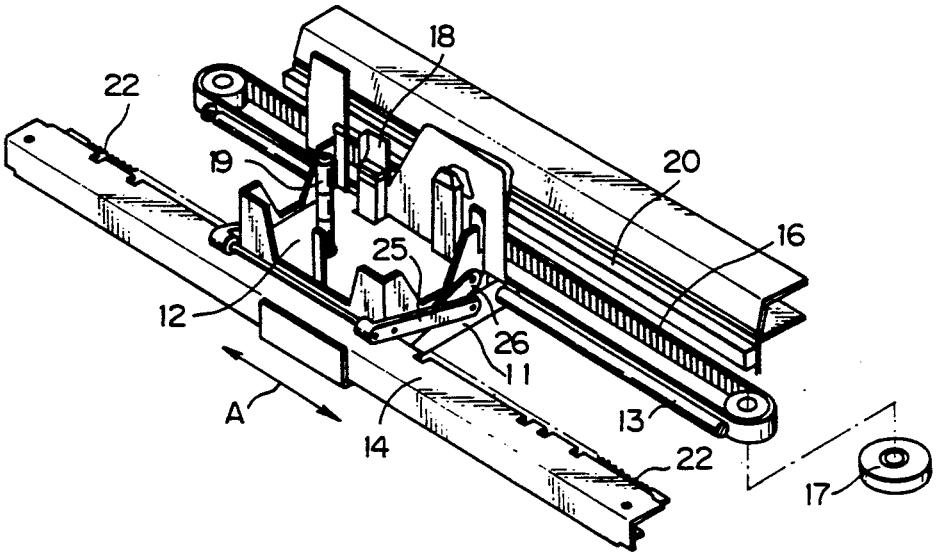
FIG. 3 is a perspective view showing construction of a carriage base viewed from the back side of FIG. 2.
Figure 4:
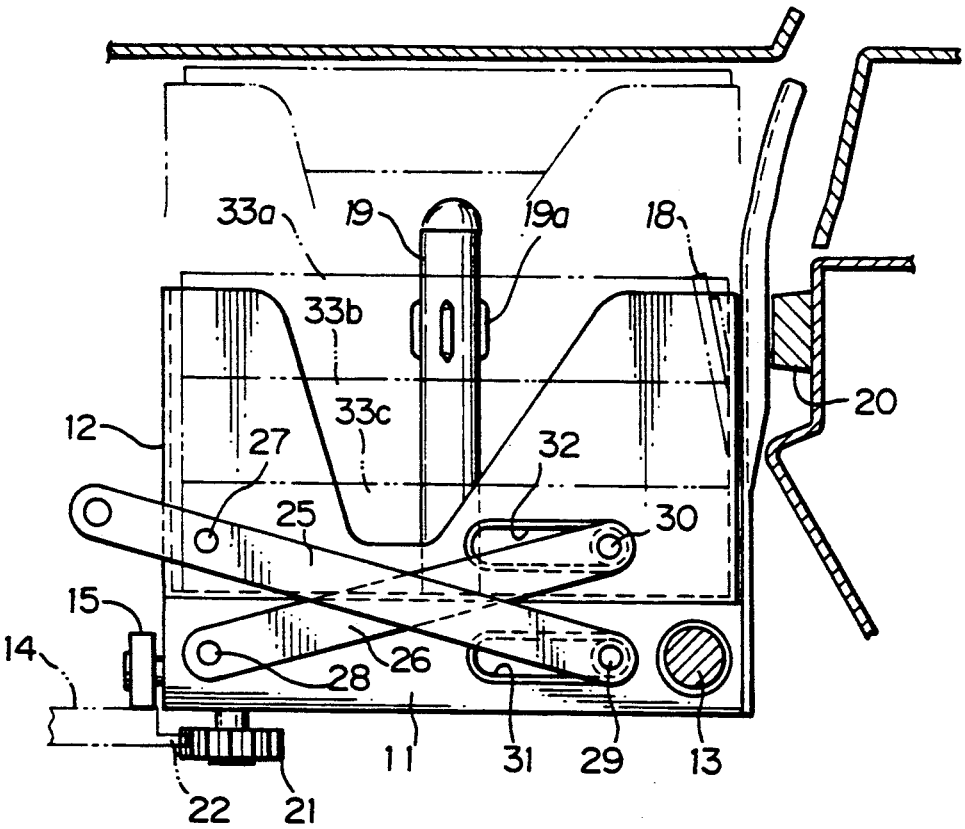
FIG. 4 is a side view showing the carriage base and a cassette table of the print unit of FIG. 2.

FIG. 2 schematically shows the construction of a print unit designed according to a preferred embodiment of the invention. FIG. 3 shows the construction of a carriage base included in the print unit shown in FIG. 2, which carriage base is viewed from the back side of FIG. 2. FIG. 4 shows the carriage base and a cassette table included in the print unit of FIG. 2, which are viewed from the side of FIG. 2.

In these figures, reference numeral 10 denotes a main frame of a print unit, and 11 denotes a carriage base of a cassette table 12 on which a plurality of ink ribbon cassettes are mounted in a stacked relationship. The carriage base 11 is supported on a guide shaft 13 laterally supported on the main frame 10 and is supported on a guide plate 14 fixed on the main frame 10 via a roller 15 (see FIG. 4).

The carriage base 11 is allowed to travel laterally along the guide shaft 13 as viewed in an arrow A (see FIGS. 2 and 3). The carriage base 11 is connected to a timing belt 16. This timing belt 16 is driven by a motor 17 rotating in both directions so that the carriage base 11 is allowed to travel laterally back and forth at a predetermined stroke.

On the carriage base 11 are provided the cassette table 12, a thermal head 18 served as a print heat, and a ribbon take-up shaft 19. A platen 20 is provided in opposition to the thermal head 18 (see FIG. 3). The ribbon take-up shaft 19 provides a drive pawl 19*a* for winding the ink ribbon at the same level as the thermal head 18. The ribbon take-up shaft 19 is designed to rotate in interlocking with a gear 21 provided on the lower portion of the carriage base 11. The gear 21 engages with a rack gear 22 fixed on and located in parallel to the guide plate 14. Hence, by laterally traveling back and forth on the carriage base 11, the gear 21 is rotated so that the ribbon take-up shaft 19 may be rotated.

In FIG. 2, element 23 denotes a feed roller for feeding paper. The feed roller 23 is rotated by the motor 24.

The cassette table 12 is mounted above the carriage base 11 by links 25 and 26 crossed like an X character. These links 25 and 26 are mounted on one side of the carriage base 11, the other side of which provides similar crossed links mounted thereon (not shown).

A middle portion of the link 25 and one end of the link 26 respectively include pins 27 and 28 mounted thereon. The pins 27 and 28 are pivotally supported on the cassette table 12 and the carriage base 11. The other ends of the links 25 and 26 respectively include guide pins 29 and 30. The guide pins 29 and 30 are inserted into slots 31 and 32 in a manner to allow these pins to move through the slots. As such, as the crossed links 25 and 26 become longer or shorter, the cassette table 12 is allowed to move up and down while remaining parallel to the carriage base 11.

As shown in FIG. 4, three ink ribbons 33*a*, 33*b*, and 33*c* for respective colors are mounted on the cassette table 12 in stacked relationship. This mounting construction allows the thermal head 18 to be inserted into a concave portion provided at the front surface of the ink ribbon cassettes 33*a*, 33*b*, and 33*c* and to be located on the rear side of the ink ribbon of each cassette.

Figure 5:
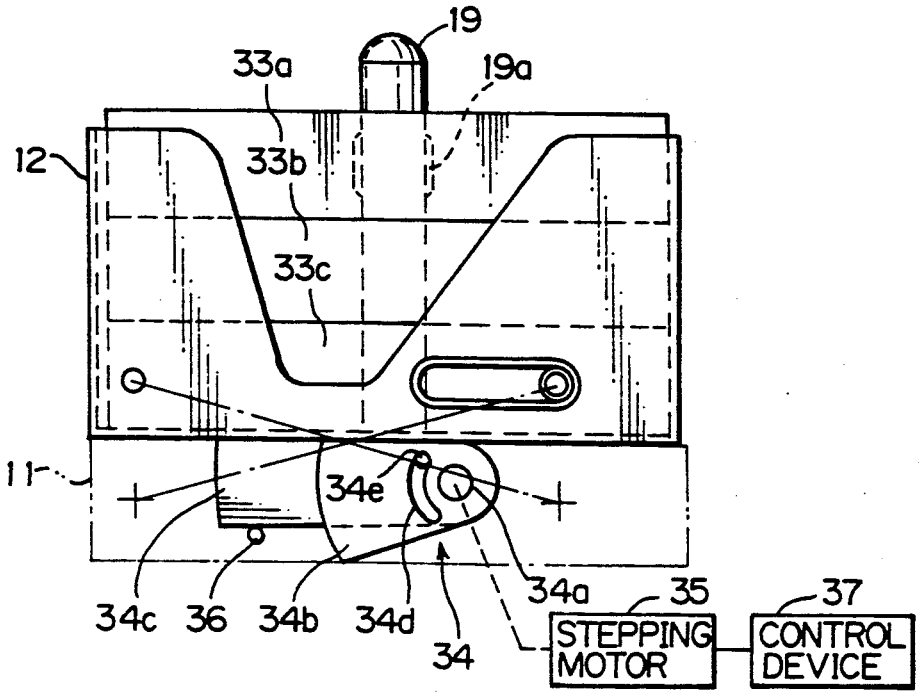
FIGS. 5 through 7 are views showing structure and operation of a drive mechanism for moving the cassette table up and down.
Figure 6:
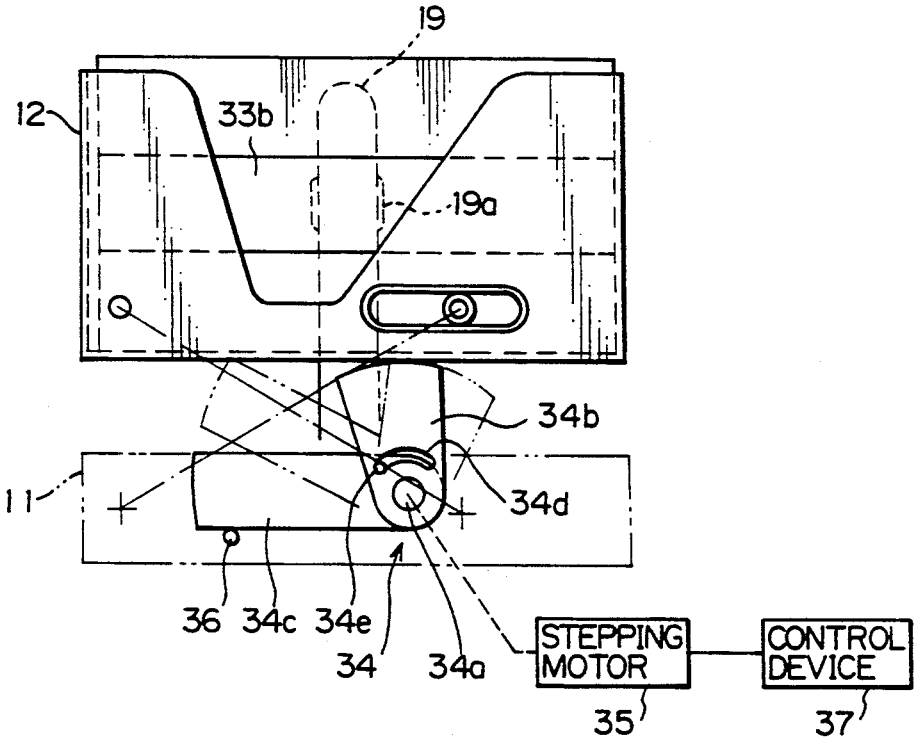
Figure 7:
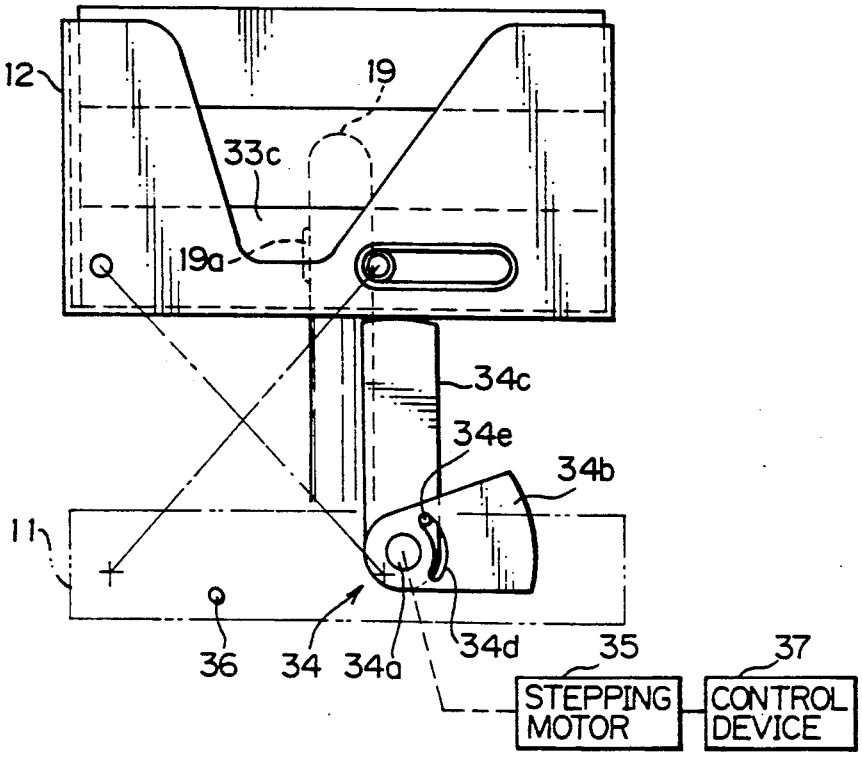

Next, the description will be directed to the structure and the operation of the lifting mechanism of the cassette table 12 with reference to FIGS. 5 through 7.

As shown in these figures, a rotary cam mechanism 34 is provided under the cassette table 12. The rotary cam mechanism 34 is rotated in both direction by a stepping motor 35 so that the cassette table 12 is allowed to move up and down. That is, the rotary cam mechanism 34 includes a drive shaft 34*a* connected to a rotary shaft of the stepping motor 35, a first cam member 34*b* fixed on the drive shaft 34*a*, and a second cam member 34*c* rotatably fitted on the drive shaft 34*a*. These first and second cam members 34*a* and 34*c* respectively include arcuate contact surfaces. The first cam member 34*b* has a smaller diameter to the contact surface than the second cam member 34*b* by a thickness of an ink ribbon cassette. The first cam member 34*b* includes an arcuate slot 34*d* into which a pin 34*e* is inserted. The pin 34*e* is formed to project from the side of the second cam member 34*c*.

In an initial state, as shown in FIG. 5, the first and second cam members 34*b* and 34*c* are rotated counterclockwise to a maximum limit. That is, the end of the slot 34*d*first cam member 34*b* is pressed on the pin 34*e* of the second cam member 34*c* and the side end of the second cam member 34*c* is pressed on the pin 36 fixed on the carriage base 11 so that both cam members 34*b* and 34*c* are prevented from rotating counterclockwise any more. In this state, the contact surfaces of both cam members 34*b* and 34*c* are prevented from pressing up the bottom of the cassette table 12. It means that the cassette table 12 is located at the lowermost point. When the cassette table 12 is located at the lowermost point, the uppermost ink ribbon cassette 33*a* positions the thermal head 18. And, the drive pawl 19*a* of the ribbon take-up shaft 19 is located inside of the ink ribbon cassette 33*a* thereby allowing only the ink ribbon cassette 33*a* to enter into a ribbon take-up state, in other words, a printable state.

When the drive shaft 34*a* is rotated clockwise about 90 degrees from the state shown in FIG. 5, it shifts to the state shown in FIG. 6. That is, the first cam member 34*b* is rotated about 90 degrees in a manner to allow the contact surface of the cam member to press up the bottom of the cassette table 12 by a certain length. In this state, the second cam member 34*c* remains in an initial state without rotation, because the opposite end of the slot 34*d* of the first cam member 34*b* is from pressing on the pin 34*e*. In the state shown in FIG. 6, the middle ink ribbon cassette 34*b* is located at the same level as the thermal head 18, thereby allowing the drive pawl 19*a* of the ribbon take-up shaft 19 to be located inside of the ink ribbon cassette 34*b*. As a result, only the ink ribbon cassette 33*b* enters into a printable state.

When the drive shaft 34*a* is rotated about 90 degrees clockwise from the state shown in FIG. 6, it enters into the state shown in FIG. 7. That is, the opposite end of the slot 34*d* of the first cam member 34*b* is pressed on the pin 34*e* of the second cam member 34*c* so that the second cam member 34*c* is rotated about 90 degrees together with the first cam member 34*b*, thereby allowing the contact surface of the second cam member to press up the bottom of the cassette table 12 by a certain length. In the state shown in FIG. 7, the lowermost ink ribbon cassette 33*c* is located at the same level as the thermal head 18, thereby allowing the drive pawl 19*a* of the ribbon take-up shaft 19 to be located inside of the ink ribbon cassette 33*c*. As a result, only the ink ribbon cassette 33*c* enters into a printable state.

If the drive shaft 34*a* is rotated counterclockwise, the cassette table 12 is lowered one step by one step as tracing back the operation disclosed in the foregoing description.

Figure 1:
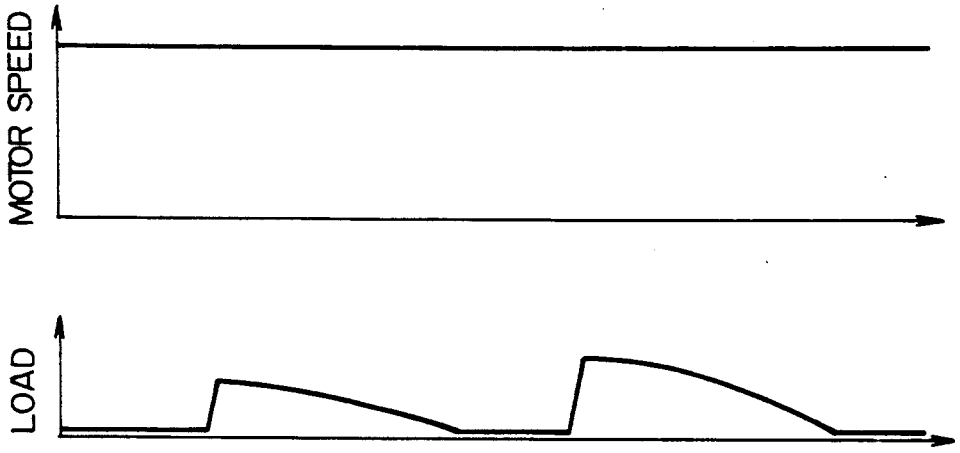
FIG. 1 is a graph showing the relation between load and rotational speed of the conventional driving motor for switching a printing ink ribbon.
Figure 8:
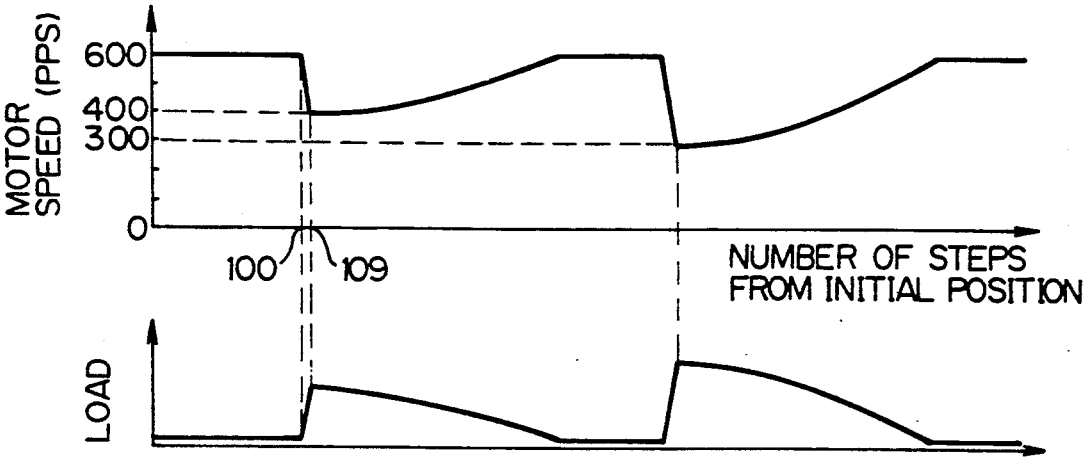
FIG. 8 is a graph showing the relation between load and rotational speed of a motor for switching an ink ribbon cassette included in the print unit of FIG. 2.

The drive shaft 34*a* of the rotary cam mechanism 34 is rotated by the stepping motor 35, the speed of which is controlled on a predetermined pattern by a control device 37 including a microcomputer. The load applied to the stepping motor 35 through the drive shaft 34*a* of the rotary cam mechanism 34 varies as shown in FIG. 8 according to a rotational angle position of the drive shaft 34*a*. The variation pattern can be obtained in advance by calculation or measurement using a dimension of the rotary cam mechanism 34 and weights of the cassette table 12 and the ink ribbon cassettes 33*a*, 33*b*, and 33*c*. It is possible to control the speed of the stepping motor 35 as shown in FIG. 8 according to the variation pattern. When a high load is applied to the motor, it is possible to prevent the stepping motor 35 from being stepped out by lowering the speed of the stepping motor 35 for increasing the drive torque. When a low load is applied to the motor, it is possible to take the steps of increasing the speed of the stepping motor 35 for preventing the motor from being heated too much as well as increasing the lifting speed of the cassette table 12 for quickly and smoothly switching the ink ribbon cassettes.

Figure 9:
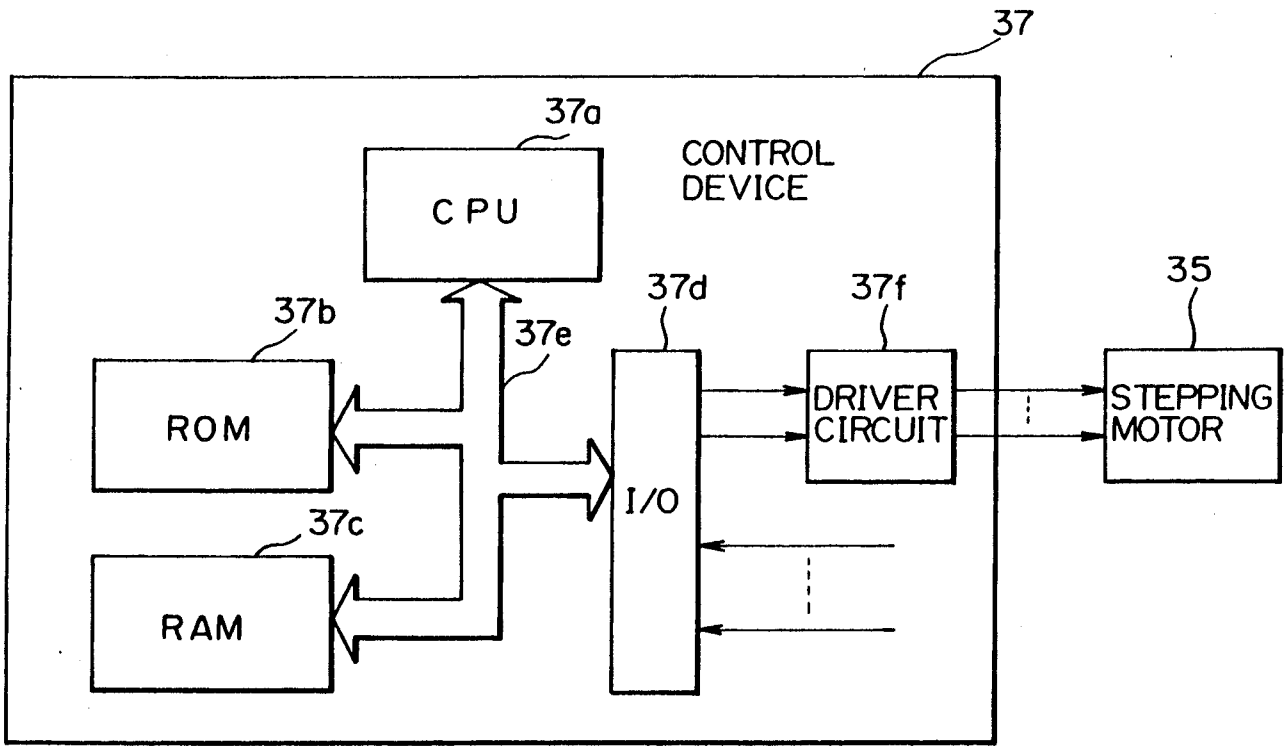
FIG. 9 is a block diagram showing a control device for controlling the rotational speed of the motor.

FIG. 9 schematically shows the control device 37 for controlling the speed. The control device 37 mainly consists of a microcomputer including a CPU 37*a*, a ROM 37*b*, a RAM 37*c*, an I/O interface 37*d*, and a bus 37*a* connecting them with one another. The I/O interface 37*d* is connected to a driver circuit 37*f* for supplying the drive current of the stepping motor 35. The CPU 37*a* serves to form a phase shift signal for driving the stepping motor 35 based on a program stored in the ROM 37*b* and apply it to the driver circuit 37*f* through the I/O interface 37*d*.

Figure 10:
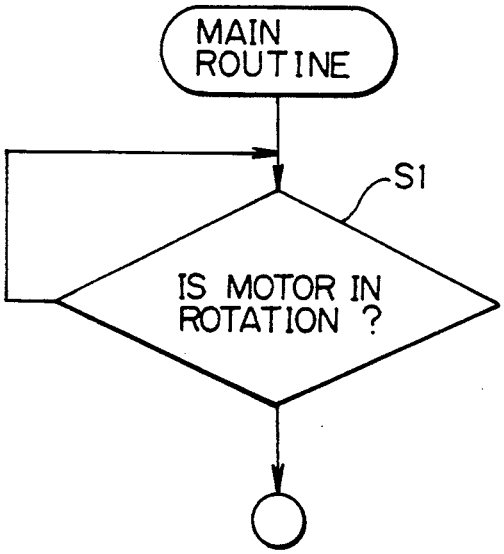
FIGS. 10 and 11 are flowcharts illustrating a portion of a speed control program contained in a microcomputer.
Figure 11:
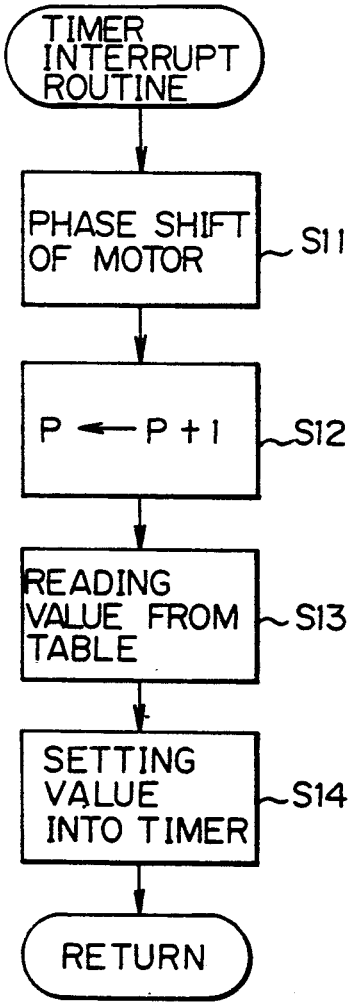

FIGS. 10 and 11 show portions of a program for controlling the motor rotation, which is included in the microcomputer. Then, the description will be directed to the motor rotation control operation with reference to those flowcharts.

In response to a signal indicating the switching of the ink ribbon cassette supplied through the I/O interface 37*d*, the control device 37 starts to control the rotation of the stepping motor 35. At a time, it sets a flag representing that the stepping motor 35 is in operation and permits a timer interruption for phase shift. As shown in FIG. 10, at a step S1 on the way of the main routine, the CPU 37*a* determines if the stepping motor is in operation based on the flag. If the motor is in operation, the CPU 37*a* iteratively performs the process of the step S1. Further, in response to an indication signal for switching from one ink ribbon cassette to another ink ribbon cassette, the CPU 37*a* recognizes the current angle position (the number of steps counted from an initial position) of the stepping motor 35 and which direction the stepping motor 35 travels and how many steps it should be rotated.

On the other hand, the ROM 37*b* stores as a table a phase shift period of time (set value of an interruption timer) in each angle position (each step counted from the initial position) of the stepping motor 35. The stepping motor 35 is switched on the phase shift period of time read at each angle position from the ROM 37*b* so as to control the speed of the stepping motor 35. That is, according to the present embodiment, the speed control is executed by controlling the phase shift period of time of the stepping motor 35. When a high load is applied to the stepping motor 35, the speed of the stepping motor 35 is controlled to be low by extending the phase shift period of time. When the low load is applied thereto, the speed of the stepping motor 35 is controlled to be high by shortening the phase shift period of time.

Table 1 represents a portion of the table, that is, the step numbers 100 to 109 of the table counted from the initial step position, and motor speeds and phase shift periods of time respectively matching to these step numbers. In this instance, the value to be set in the timer is based on a unit of μsec.

TABLE 1

| NUMBER OF STEPS FROM INITIAL POSITION | MOTOR SPEED (pps) | PHASE SHIFT PERIOD OF TIME (msec) | VALUE TO BE SET IN TIMER |
|---|---|---|---|
| 100 | 600.0 | 1.667 | 1667 |
| 101 | 581.2 | 1.720 | 1720 |
| 102 | 561.8 | 1.780 | 1780 |
| 103 | 541.6 | 1.846 | 1846 |
| 104 | 520.7 | 1.920 | 1920 |
| 105 | 498.9 | 2.004 | 2004 |
| 106 | 476.1 | 2.100 | 2100 |
| 107 | 452.2 | 2.212 | 2212 |
| 108 | 426.9 | 2.343 | 2343 |
| 109 | 400.0 | 2.500 | 2500 |

The CPU 37*a* reads the value to be set in the timer from the table stored in the ROM 37*b*. An interrupt takes place after the timer counts the set value. It results in shifting the phase of the stepping motor 35 so that the stepping motor 35 rotates by a predetermined angle, that is, one step FIG. 11 shows the timer interrupt routine. This interrupt routine takes the following steps: at a step S11, executing phase shift of the stepping motor 35 when a timer interrupt takes place; at a step S13, incrementing the pointer P of the table as P.P+1; at a step S13, reading the next value to be set in the timer on the incremented pointer P; and at a step S14, setting the value read at the step S14 to the timer. Then, the program finishes this interrupt routine and returns to a main routine. After the timer counts this set value, the interrupt shown in FIG. 11 takes place again. It results in executing a similar process so that the stepping motor 35 is rotated by one step. If the motor is rotated by the number of steps defined by repeating the phase shift of stepping motor 35, it is when the rotation control operation of the stepping motor 35 finishes. It means that the phase-shift timer interrupt is prohibited when the flag is reset. By setting the flag, the main routine escapes out of the step S1 and goes to the next step.

The foregoing embodiment discloses a printer provided with three ink ribbon cassettes. In practice, however, the number of ink ribbon cassettes may be any one except one, though the number of cam members is defined according to the number of ink ribbon cassettes. The structure of a cam mechanism for moving up and down the cassette table is not limited to that disclosed in the embodiment.

Many widely different embodiments of the present invention may be constructed without departing from the spirit and scope of the present invention. It should be understood that the present invention is not limited to the specific embodiments described in the specification, except as defined in the appended claims.

What is claimed is:

1. A printer with a plurality of ink ribbon cassettes, using a selected one of said ink ribbon cassettes, said printer comprising:

a vertically movable cassette table for mounting, in a stacked relationship, the plurality of ink ribbon cassettes;

a stepping motor;

a rotary cam mechanism connected to said stepping motor and to said cassette table, and rotated by said stepping motor, for moving said cassette table up and down;

storage means for pre-storing rotational speed data of said stepping motor at each rotational angle of said rotary cam mechanism, said data being arranged to depend on a load variation caused by the rotation of said rotary cam mechanism so that a rotational speed of said stepping motor is decreased when the load applied to said stepping motor increases, and that the rotational speed is increased when the load applied to said stepping motor decreases; and means for controlling a rotational speed of said stepping motor according to the rotational speed data corresponding to each rotational angle of said rotary cam mechanism, read out from said storage means.

2. The printer as claimed in claim 1, wherein said storage means pre-stores the rotational speed data arranged to decrease the rotational speed in case of increasing load applied to said stepping motor together with the rotation of said rotary cam mechanism, said speed data being pre-stored for each rotational angle of said rotary cam mechanism.

3. The printer as claimed in claim 2, wherein said storage means pre-stores the rotational speed data arranged to increase the rotational speed in case of decreasing load applied to said stepping motor together with the rotation of said rotary cam mechanism, said speed data being pre-stored for each rotational angle of said rotary cam mechanism.

4. The printer as claimed in claim 1, wherein said storage means pre-stores the rotational speed data arranged to increase the rotational speed in case of decreasing load applied to said stepping motor together with the rotation of said rotary cam mechanism, said speed data being pre-stored for each rotational angle of said rotary cam mechanism.

5. The printer as claimed in claim 1, wherein the rotational speed data stored in said storage means indicates a phase shift period of time of said stepping motor.

6. The printer as claimed in claim 5, wherein said storage means is a ROM table.

7. The printer as claimed in claim 5, wherein said control means serves to control a phase shift period of time of said stepping motor according to the data about the phase shift period of time, said data corresponding to each rotational angle of said rotary cam mechanism read out of said storage means.

8. The printer as claimed in claim 7, wherein said control means includes timer means providing set data about the phase shift period of time read out of said storage means and means for indicating the phase shift of said stepping motor when said timer means finishes a count of said set data.

9. The printer as claimed in claim 8, where said control means includes a programmed microcomputer which controls the rotational speed of said stepping motor.

10. The printer as claimed in claim 1, wherein said rotary cam mechanism includes a contact surface against which the bottom of said cassette table is pressed when said stepping motor rotates said rotary cam mechanism whereby said cassette table is allowed to move up and down by pressing said contact surface on said bottom surface.

11. The printer as claimed in claim 10, wherein said rotary cam mechanism includes a plurality of cam members having respective diameters to the contact surface.

12. The printer as claimed in claim 11, wherein the number of said cam members are same as that of said ink ribbon cassettes mounted in a stacked relationship.

13. The printer as claimed in claim 11, wherein the difference between diameters of said adjacent cam members is equal to the thickness of said ink ribbon cassette.

14. A printer with a plurality of ink ribbon cassettes and a print head, a selected one of said ink ribbon cassettes for respective colors being capable of opposing said print head, said printer comprising:

a vertically movable cassette table for mounting, in a stacked relationship, the plurality of ink ribbon cassettes;

a stepping motor;

a rotary cam mechanism connected to said stepping motor and to said cassette table and rotated by said stepping motor, for moving said cassette table up and down;

storage means for pre-storing rotational speed data of said stepping motor at each rotational angle of said rotary cam mechanism, said data being arranged to depend on a load variation caused by the rotation of said rotary cam mechanism so that a rotational speed of said stepping motor is decreased when the load applied to said stepping motor increases, and that the rotational speed is increased when the load applied to said stepping motor decreases; and means for controlling the rotational speed of said stepping motor according to the rotational speed data for each rotational angle of said rotary cam mechanism, read out from

* * * * *